United States Patent [19]

Sandhage

[11] Patent Number: 4,764,151

[45] Date of Patent: Aug. 16, 1988

[54] PIVOTABLE COIN LOADING APPARATUS

[76] Inventor: Douglas E. Sandhage, 9 Sandhage Dr., Pearl River, N.Y. 10965

[21] Appl. No.: 908,751

[22] Filed: Sep. 18, 1986

[51] Int. Cl.[4] ..... G07D 9/00

[52] U.S. Cl. ..... 453/59; 453/61; 53/254

[58] Field of Search ..... 133/1 R, 1 A, 8 A, 8 B, 133/8 D, 8 R; 53/212, 213, 254, 532; 453/58, 59, 60, 61, 62, 63

[56] References Cited

U.S. PATENT DOCUMENTS

| | | | |
|---|---|---|---|
| 961,473 | 6/1910 | Abbott | 53/254 X |
| 1,085,673 | 2/1914 | Doldt | 53/254 |
| 1,171,409 | 2/1916 | Bisland | 133/1 A X |
| 1,241,632 | 10/1917 | Johnson | 453/62 X |
| 2,215,858 | 9/1940 | Slootsky | 133/1 |
| 2,302,861 | 11/1942 | Hinkel | 133/1 |
| 2,342,761 | 2/1944 | Simpson | 53/213 |
| 2,549,299 | 4/1951 | Drury | 53/254 |
| 2,620,109 | 12/1952 | Smathers | 226/14 |
| 2,645,397 | 7/1953 | McCallick et al. | 133/1 A X |
| 2,736,478 | 2/1956 | Bernhardt, Jr. | 53/254 |
| 2,836,019 | 5/1958 | Oltarzewski | 53/254 |
| 2,864,386 | 12/1958 | Allen | 133/8 |
| 2,941,342 | 6/1960 | Allen | 453/59 X |
| 2,952,108 | 9/1960 | Ullman | 53/254 |
| 3,107,467 | 10/1963 | Gates | 53/254 |
| 3,206,914 | 9/1965 | Norris | 53/254 |
| 3,678,650 | 7/1972 | Green, Jr. | 133/1 A X |
| 4,091,599 | 5/1978 | Lemieux | 133/1 A X |
| 4,244,157 | 1/1981 | Vondra et al. | 133/1 A X |
| 4,339,071 | 7/1982 | Hall | 232/5 |

FOREIGN PATENT DOCUMENTS

| | | |
|---|---|---|
| 472906 | 3/1929 | Fed. Rep. of Germany . |
| 505070 | 8/1930 | Fed. Rep. of Germany . |

*Primary Examiner*—Joseph J. Rolla
*Assistant Examiner*—Edward S. Ammeen
*Attorney, Agent, or Firm*—Blum Kaplan

[57] ABSTRACT

A coin loader for loading a stack of coins including a base having a stacking end and a mounting end is provided. An arcuate trough inclined at an angle is affixed at the stacking end of the base. A pivotable mount which enables the mounting of a coin wrapper is affixed at the mounting end of the base. The pivotable mount pivots from a first position for mounting the wrapper and a second position for loading the coins into the wrapper. The arcuate trough includes two side walls to assist in positioning the wrapper.

10 Claims, 3 Drawing Sheets

A
1
2
3
7
8
9
10
11a
11b
14
16
18
20
21
22a
23
24
50
51
52

5
5

PIVOTABLE COIN LOADING APPARATUS

BACKGROUND OF THE INVENTION

This invention is directed to an apparatus for loading coins into a coin wrapper and, in particular, to an apparatus that stacks and counts coins and then loads them into an awaiting coin wrapper.

The stacking and counting of coins, as well as dispensing them into containers, is well known in the art. A stacking and dispensing system is described in U.S. Pat. No. 2,549,299. This device consists of a trough with a back wall, the trough being supported on rounded runners. At the far end of the trough is a lip. The lip is inserted into a wrapper, and the coins are stacked along the trough until a desired number is in place. The trough is then rocked forward and the coins slide into the wrapper at the lip of the trough.

Another device for stacking and packing coins is described in U.S. Pat. No. 3,678,650 and is particularly characterized by stacking coins above a wrapper in a block. The block is supported above a base, having holes bored through to a given height. At the bottom of each bore is a slideable plate having a hole bored therethrough and a section of each plate being solid. The coins are supported in the bores of the block on these plates. Below the plate is a space and positioners for a wrapper to be inserted. When the desired number of coins is reached, the plate is slid so that when the hole is connected with the bore, the coins drop through the bore and into the wrapper.

A device for packing coins is described in U.S. Pat. No. 3,206,914. This device contains two pieces, a mandril and a funnel. The mandril is inserted into the paper wrapper at its one end while the paper wrapper is inserted into a funnel tube at its other. The mandril length inserted into the tube is equal to the unused portion of the wrapper, or the amount needing to be crimped. Coins are inserted into the funnel until they are stacked to an appropriate height. The funnel is then removed, the end is crimped, the mandril end is removed and is crimped.

Each of the aforenoted prior art coin loading devices are less than completely satisfactory because they are either intricately constructed or require extensive manipulation in order to count, load, and wrap coins. Those that are not intricately constructed do not provide a way of readily preparing the wrapper for crimping once they have been loaded. Those that do prepare the coins for crimping while loaded do not provide a way of counting or stacking the coins. Accordingly, a coin loader that overcomes the shortcomings of the prior art devices described above is desired.

SUMMARY OF THE INVENTION

Generally speaking, in accordance with the instant invention, a coin loader has a base having a mounting end and a stacking end. In an exemplary embodiment, an arcuate trough is disposed at the stacking end of the base. A pivotable mount which enables a coin wrapper to be mounted thereon is disposed at the mounting end of the base. The mount pivots from a first position for mounting the wrapper to a second position for loading coins into the wrapper.

Accordingly, it is an object of the instant invention to provide an improved coin loader.

Another object of the instant invention is to provide a coin loader which is easy to use, requiring few manipulations by the user.

Still a further object of the instant invention is to provide a coin loader which automatically prepares the coins for crimping.

Yet another object of the instant invention is to provide a single counting apparatus for coins and for preparing the wrapper for crimping.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figures 1, 2:
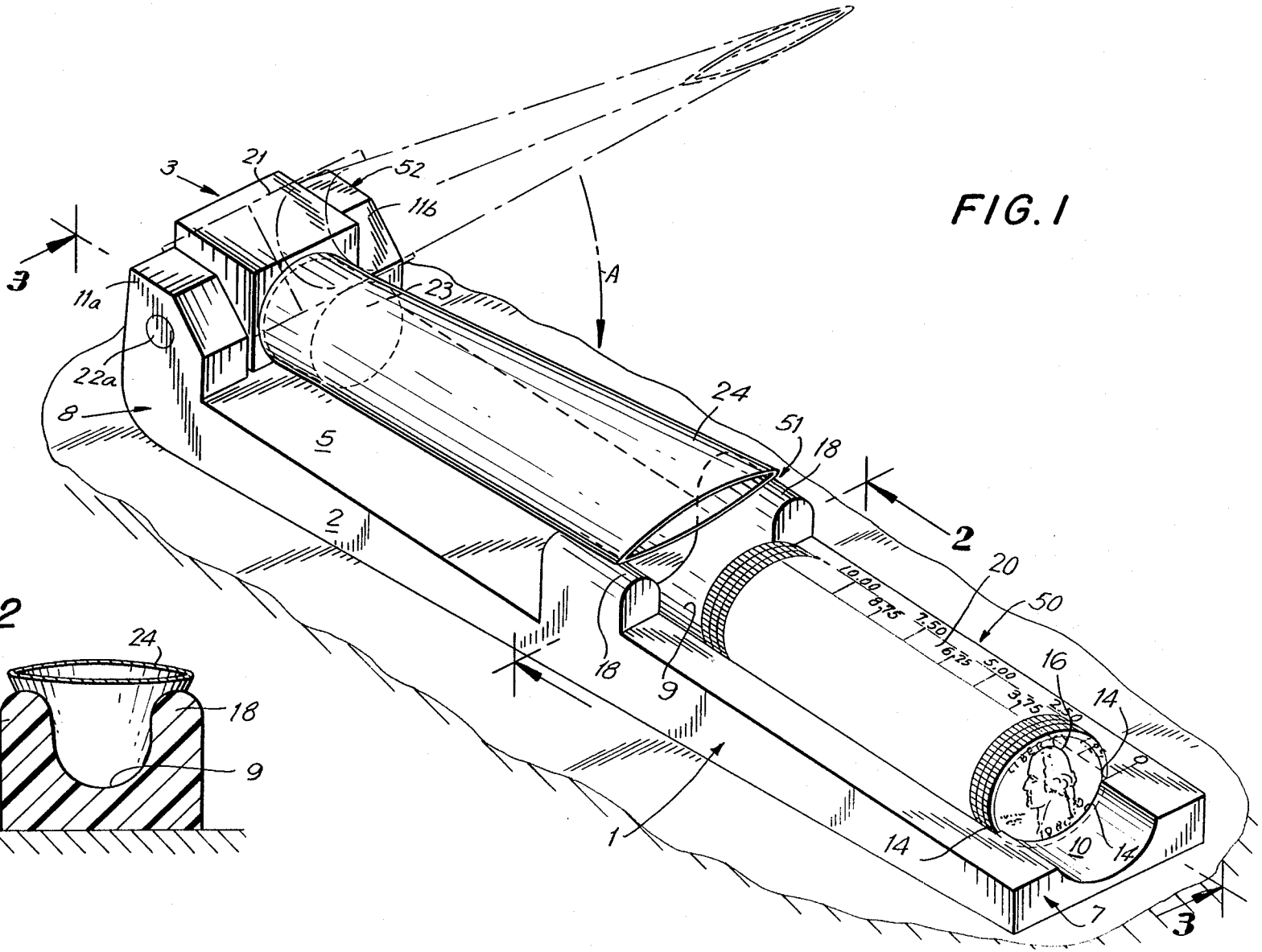
FIG. 1 is a perspective view of a coin loader constructed in accordance with a preferred embodiment of the instant invention.
FIG. 2 is a sectional view taken along line 2—2 of FIG. 1.

Reference is first made to FIG. 1 wherein a coin loader assembly generally indicated as 1 and constructed in accordance with a preferred embodiment of the instant invention is depicted. Coin loader assembly 1 includes a base 2, and a pivotable mount 3.

Base 2 includes a mounting end, generally indicated at 8, and a stacking end, generally indicated at 7. Bse 2 includes a stacking station, generally indicated at 50, wrapper receiving station, generally indicated at 51, and a pivoting assembly, generally indicated at 52. Stacking station 50 includes a trough 9 extending from stacking end 7 to the receiving station 51. The diameter of trough 9 is larger than the diameter of the particular sized coins 16 that are to be loaded, but is of sufficient dimension to permit a plurality of coins 16 to be aligned in a single row, while permitting the coins 16 to easily slide forward in trough 9, but not allow lateral movement of coin 16 within trough 9. At stacking end 7, trough 9 includes a stop wall 14. In a preferred embodiment, stop wall 14 is defined by an auxiliary trough 10 of smaller diameter coaxially oriented with trough 9. Auxiliary trough 10 provides easy access to stacking station 50 during loading but is not essential to the operation of the instant invention.

Trough 9 extends from stop wall 14 to receiving station 51. In an exemplary embodiment, the receiving station 51 includes two receiving walls 18. As is best illustrated in FIG. 5, walls 18 project to a height that approximates the diameter of coins 16 to facilitate loading in a manner to be discussed below.

Trough 9 is disposed on an incline from receiving station 51 to stop wall 14 so that the trough at the receiving station is at a higher elevation than at the stop wall. This incline insures that a stack of coins 16 will come to rest at the stop wall 14 when coins 16 are loaded.

Uprights 11*a* and 11*b* are disposed at mounting end 8 for receiving the pivot mount assembly 3 therein. Pivotable mount 3 includes a block 21 having pivot pins 22*a* and 22*b* pivotally resting in pivot opening in uprights 11*a* and 11*b*, respectively. Block 21 is able to pivot through at least a 30° path beginning at platform surface 5 of base 1 in the direction of the arrow A in FIG. 1. A cylindrical plug 23 projects from block 21 so that when block 21 is pivoted towards base 1, plug 23 becomes coaxial with trough 9. Plug 23 is configured with the same diameter as coin 16, and is of a diameter that is less than the respective dimensions of block 21. Accordingly, a coin wrapper 24 may be placed over plug 23, and will slide down plug 23 until it comes in contact with block 21. In an exemplary embodiment, the axial length of plug 23 is sufficient to permit the wrapper to be crimped at the plug end after coins 16 are loaded therein.

Figures 3, 4, 5:
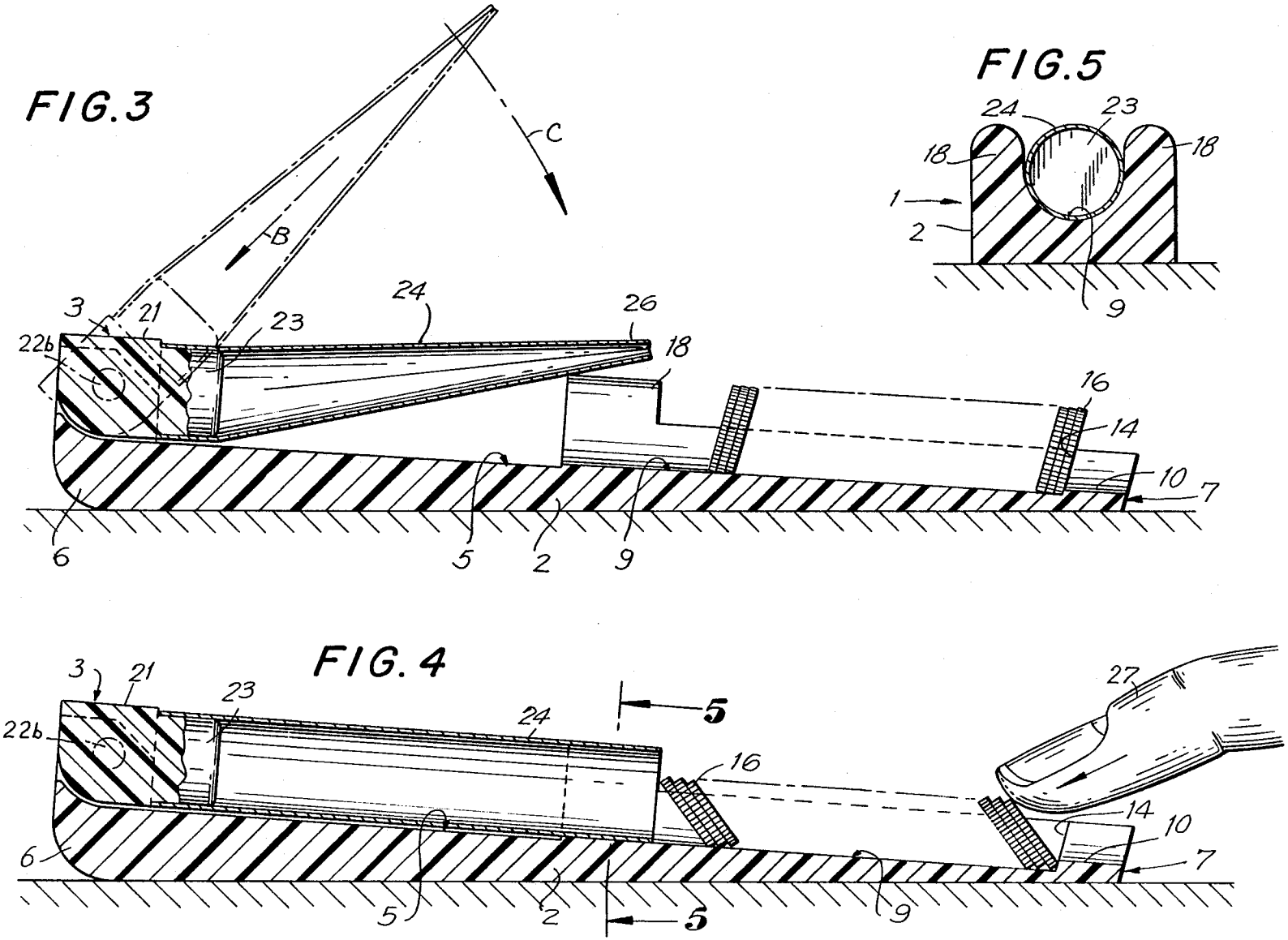
FIG. 3 is a sectional view taken along line 3—3.
FIG. 4 is the same sectional view as FIG. 3 illustrating the operation of the coin loader.
FIG. 5 is a sectional view taken along line 5—5 of FIG. 4.

Reference is now made to FIGS. 3, 4 and 5 wherein a first method of operation of the coin loader is depicted. Coins 16 are placed in trough 9 until the desired number of coins are stacked. Block 21 is pivotted so that plug 23 is oriented in a relatively upward direction from surface 5 of base 1. Wrapper 24 is placed over plug 23 and slid over plug 23 as indicated by the arrow B in FIG. 3, until it comes to rest in contact with block 21. Wrapper 24 is normally shipped in a folded flat condition, therefore, end 26 of wrapper 24 normally has a flat depressed shape Wrapper 24 is placed on plug 23 so that when pivoted the crease of wrapper 24 will parallel to receiving walls 18. In this flat orientation wrapper 24 has a wider diameter than trough 9. Block 21 is pivotted towards trough 9 as indicated by arrow C in FIG. 3, until wrapper 24 comes to rest within receiving walls 18. Receiving walls 18 keep wrapper end 26 open and aligned with coins 16 due to the larger diameter of creased wrapper 24. This insures smooth sliding of coins 16 into wrapper 24.

Plug 23 is in the down position, wrapper 24 is open and coaxial with coins 16 and parallel to base 2. Due to the incline of the trough, coins 16 are stacked to that the stack leans against stop wall 14. The stack of coins is given a slight push at their top from behind stop wall 14 by a finger 27. The stack of coins are now tilted in an orientation towards the wrapper. The stack of coins are now easily pushed into wrapper 24 by a finger.

Figure 7:
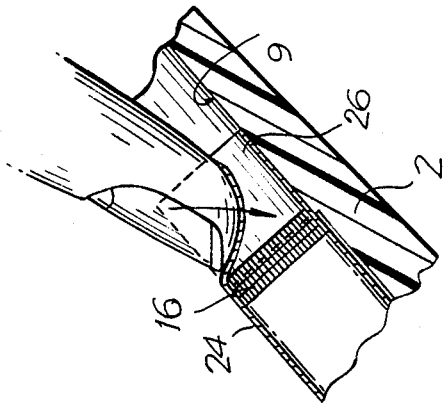
FIG. 7 is a partial sectional view of the coin loader depicted in FIG. 6 further illustrating the operation of the coin loader.
Figure 8:
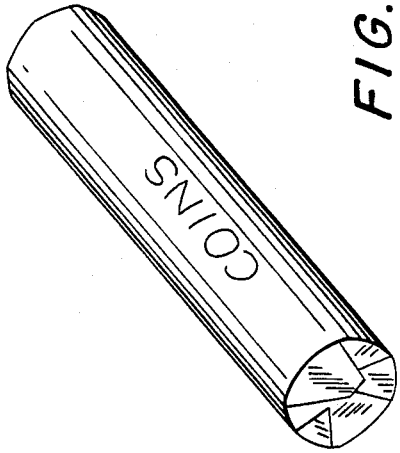
FIG. 8 is a perspective view of a stack of coins wrapped and loaded by the instant invention.

Coins 16 stack themselves within wrapper 24 and come to rest against plug 23. When the entire stack of coins 16 is loaded, wrapper end 26 is then crimped in a manner depicted in FIG. 7. Wrapper 24, with coins 16 therein, is then removed from plug 23 and the other end of wrapper 24 is crimped leaving a sealed wrapper as depicted in FIG. 8.

Figure 6:
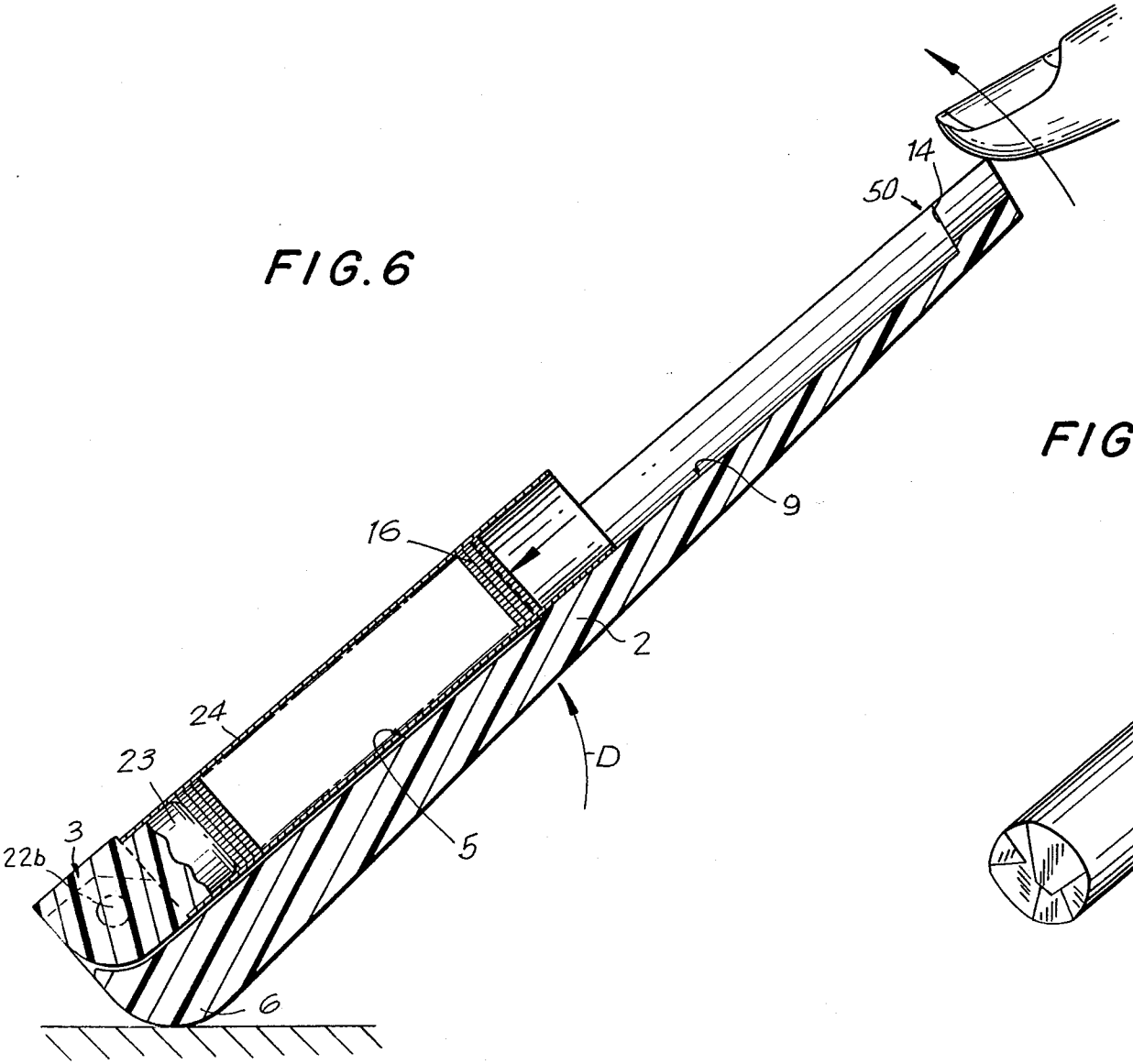
FIG. 6 is the same sectional view as FIG. 3 and further illustrating the operation of the coin loader.

Rounded corner 6 allows the coin loader to operate in another manner. After tilting coins 16 as in FIG. 4, stacking end 50 of base 2 is tilted in the direction of the arrow D in FIG. 6, each of the coins slide unaided into wrapper 24. The crimping process is then performed in exactly the same manner as previously described.

An indicia 20 in the form of a scale can be affixed adjacent trough 9. Indicia 20 is marked to indicate the total value of coins 16 contained in trough 9 at any given distance from stop wall 14.

It will thus be seen that the objects set forth above, and those made apparent in the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A coin loader for laoding a stack of coins into a coin wrapper comprising;

a base having a mounting end and a stacking end, stacking means disposed in the base for receiving a stack of coins at the stacking end thereof, including an inclined trough, so that the mounting end is elevated with respect to the stacking end, said trough having a diameter slightly larger than the coin to be loaded;

two receiving walls, said receiving walls being secured to the side walls of the trough, one at each side of the trough at the elevated end of the trough, spaced apart a distance less than the diameter of the wrapper, said receiving walls keeping said wrapper open when said wrapper is in a loading position;

a stop wall affixed at the stacking end; and pivotable mounting means for receiving said coin wrapper at the mounting end of the base pivotably mounted with respect to said base including a first upright and a second upright, said first and second uprights being secured to said base in facing relationship to each other, a pin, said pin passing through said first upright and second upright, a block pivotably supported about the pin and a plug mounted on said block, said plug extending into said coin wrapper and positioning the coins in the wrapper so that a space is left at each end of said wrapper sufficient to allow crimping of said wrapper.

2. The coin loader, as claimed in claim 1, wherein said plug has a diameter slightly greater than the coin, and entends into said wrapper a length equal to the lengths of the wrapper needed to crimp each end of the wrapper sealing the coins within.

3. The coin loader, as claimed in claim 1, wherein said stacking means and said mounting means are a distance apart so that when the pivotable mounting means is in a loading position, the wrapper loaded on the pivotal mounting means lies at least between the receiving walls.

4. The coin loader, as claimed in claim 2, further comprising a tilting means for tilting the coin loader to allow the coins to fall into the wrapper unaided.

5. The coin loader, as claimed in claim 4, wherein the tilting means comprises a rounded corner at the mounting end of said base.

6. The coin loader, as claimed in claim 4, wherein the coin is a quarter.

7. The coin loader, as claimed in claim 4, wherein the coin is a penny.

8. The coin loader, as claimed in claim 4, wherein the coin is a dime.

9. The coin loader, as claimed in claim 4, wherein the coin is a nickle.

10. The coin loader as claimed in claim 1, further comprising: indicia forming a scale positioned along the lengthwise extent of the trough mounted to said trough, said scale depicting the value of coins positioned within said trough, said scale depicting the value of coins positioned within said trough at any given point, when said coins are stacked against said stop wall.

* * * * *